United States Patent [19]

Belcourt et al.

[11] 4,422,066

[45] Dec. 20, 1983

[54] CONDITION SENSOR INTERFACE MEANS

[75] Inventors: Francis J. Belcourt, Shakopee; Martin J. van Dyke, Brooklyn Park, both of Minn.

[73] Assignee: Honeywell Inc., Minneapolis, Minn.

[21] Appl. No.: 309,739

[22] Filed: Oct. 8, 1981

[51] Int. Cl.[3] ..... G08B 23/00; H01N 35/00

[52] U.S. Cl. ..... 340/500; 340/517; 340/501; 340/518; 340/531; 340/870.17; 340/602; 328/3; 328/4; 307/116; 307/310; 307/475; 374/132; 374/142

[58] Field of Search ..... 340/500, 501, 506, 517, 340/518, 521, 531, 577–579, 584, 588, 589, 602, 870.16, 870.17, 825.03, 825.06, 825.86, 825.89; 328/3, 4, 152; 307/231, 310, 116, 117, 475; 374/100, 101, 102, 103, 132, 133, 142

[56] References Cited

U.S. PATENT DOCUMENTS

| | | | |
|---|---|---|---|
| 3,750,155 | 7/1973 | Oman | 340/870.04 |
| 3,891,914 | 6/1975 | Akita | 307/261 |
| 3,938,144 | 2/1976 | Pederson et al. | 340/660 |
| 4,031,528 | 6/1977 | Harrison | 307/248 |
| 4,198,625 | 4/1980 | Mande et al. | 340/517 |
| 4,225,860 | 9/1980 | Conforti | 340/517 |

OTHER PUBLICATIONS

Technology News "Multifunction Monitor/Alarm IC's", Jim McDermott, vol. 24, No. 14, Aug. 5, 1979.

*Primary Examiner*—Donnie L. Crosland
*Attorney, Agent, or Firm*—Alfred N. Feldman

[57] ABSTRACT

Two condition sensors of two entirely different types are selected and monitored by a single condition sensor interface means. The interface means provides for selection of the sensor to be activated, or can be operated in a mode to repetitively sample both sensors. The sensors rely on a hybrid type device utilizing an integrated circuit, discrete components, and a mounting substrate. The sensors may be mounted on the substrate for temperature stability.

13 Claims, 5 Drawing Figures

TIMING DIAGRAM FOR SENSOR SWITCHING

CONDITION SENSOR INTERFACE MEANS

BACKGROUND OF THE INVENTION

The sensing of various conditions for indicating and control purposes is an old and highly developed technology. Typically, a condition sensor is mounted in an area where a condition is to be monitored and conductors then lead from that location to appropriate amplifiers and circuitry to interpret the state of the condition sensor. In the event that more than one condition is to be monitored, a plurality of condition sensors are provided and are individually connected through individual sensing channels or are selectively switched so that a single piece of amplifying or interpreting equipment can be used with the multiple sensors. The use of this type of technology requires a significant amount of interconnection wiring between the sensors and an output device responsive to the sensors.

In many installations, two conditions are sensed and used for indication and control purposes. More particularly, in residential environment control, the temperature and humidity of a controlled location are of importance. In winter time operation a heating plant normally responds both to a sensed temperature and the ambient is monitored for a proper humidity level. Normally when two conventional sensors for the humidity and temperature are mounted in a controlled environment, two sets of wires are required from the sensors to the control or indicating equipment. This redundant wiring adds significantly to the cost of an installation and to the equipment involved in the sensing and control of the ambient conditions.

SUMMARY OF THE INVENTION

The present invention is directed to a unique type of condition sensing device that simplifies the wiring required where two remote sensors are used for either indication or control. In the present invention two sensors having entirely different characteristics, such as a temperature responsive resistor, and a voltage generating type of sensor responsive to humidity, can be mounted on a substrate. The substrate in turn mounts a sensor interface means in the form of both integrated circuitry and discrete components that are electrically interconnected on the substrate to form a unitary package. This unitary package is supplied with a direct current potential over a pair of conductors. This same pair of conductors is used for outputting the condition being sensed by either or both of the sensors. A terminal on the substrate is designed for connection to either ground or the positive potential supplied to the substrate. This selection then allows the equivalent of the digital logic 1 or the digital logic 0 to be introduced into the sensor interface means to cause the device to select one or the other of the sensors. In a further version of the present invention the use of digital logic allows for the selection of an alternate action which outputs information continuously from the two sensors, or allows for the selection of only one of the two sensors. Regardless of which version of the present invention is used, the sensors that are mounted on the substrate are capable of both receiving power from the substrate over a pair of conductors, and outputting the sensed information on the same pair of conductors.

In a further version of the present device, the sensors are mounted remote from the substrate itself, but still control in the same manner as if they were mounted directly on the substrate. In mounting the sensors directly on the substrate, certain temperature problems are overcome since the electronics which interpret the status of the sensors are at the same temperature as the sensors, and therefore certain temperature compensation problems are eliminated. Regardless of whether the sensors are mounted on the substrate, whether the selection process is automatically done on a continuous alternating basis, or by selection of a particular sensor by inputting the proper digital voltage on an input terminal, the output of the sensors is provided as a digital signal on the same pair of conductors as the direct current potential which supplies the operating voltage for the electronics involved.

DESCRIPTION OF THE PREFERRED EMBODIMENTS

Figure 1:
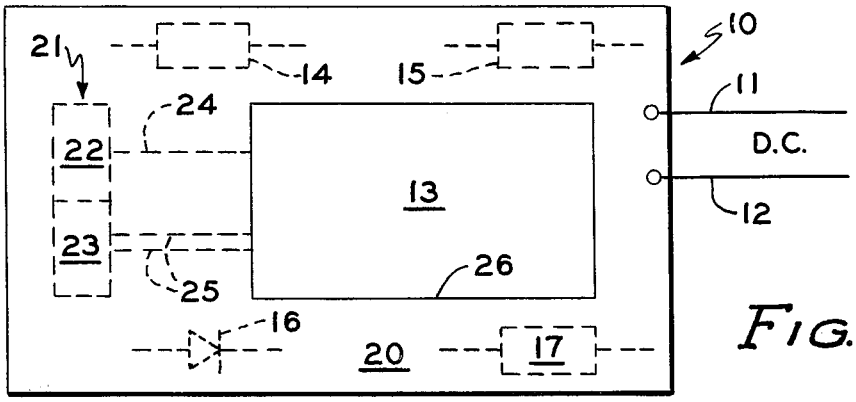
FIG. 1 is a block representation of the overall device.

In FIG. 1 a complete condition sensor interface means is disclosed generally at 10. The condition sensor interface means 10 is connected by a pair of conductors 11 and 12 to a low voltage direct current source of potential. The conductors 11 and 12 are used in the present device not only to supply a direct current potential to the condition sensor interface means 10, but are used as the output conductors for the sensed condition. The manner in which this is accomplished will become apparent after a description of the complete device.

The condition sensor interface means 10 includes an integrated circuit 13 that forms part of the sensor interface means and further includes a number of discrete components disclosed at 14, 15, 16, and 17. The integrated circuit 13 and the discrete components 14, 15, 16, and 17 are mounted on a ceramic substrate disclosed at 20 that forms an insulating mounting surface for the overall device. This technology generally is referred to as hybrid circuit technology and forms a convenient means of fabricating the present device. The device is completed by the mounting of condition sensor means generally disclosed at 21. The condition sensor means 21 is in fact made up of two separate sensors 22 and 23 that are shown individually connected at 24 and 25 to the integrated circuit 13. The two sensors 22 and 23 could be mounted remote from the substrate 20, but in the preferred embodiment they are mounted on the substrate and therefore are at the same temperature as the rest of the electronics in order to avoid problems with temperature compensation. This also provides a simple mounting technique for the overall condition sensor interface means. An important aspect of the present device is the fact that two individual sensors 22 and 23 make up the condition sensor means 21 for the same condition sensor interface means. The condition sensor interface means 10 is capable of selecting two different modes of operation which allow for selecting the sensor 22, the sensor 23, or a combination thereof, as will be explained in connection with FIGS. 2 and 3.

The essential part of the present device is the fact that the overall condition sensor interface means 10 is formed having two selectable modes of operation to select between the sensors 22 and 23, and that the device is powered over a pair of conductors 11 and 12 with the same conductors 11 and 12 being used to output information about the sensed condition. This allows for the formation of a condition sensor interface means 10 that is compact and requires only two conductors from the sensor means back to a point where the sensed information is interpreted or utilized.

Figure 2:
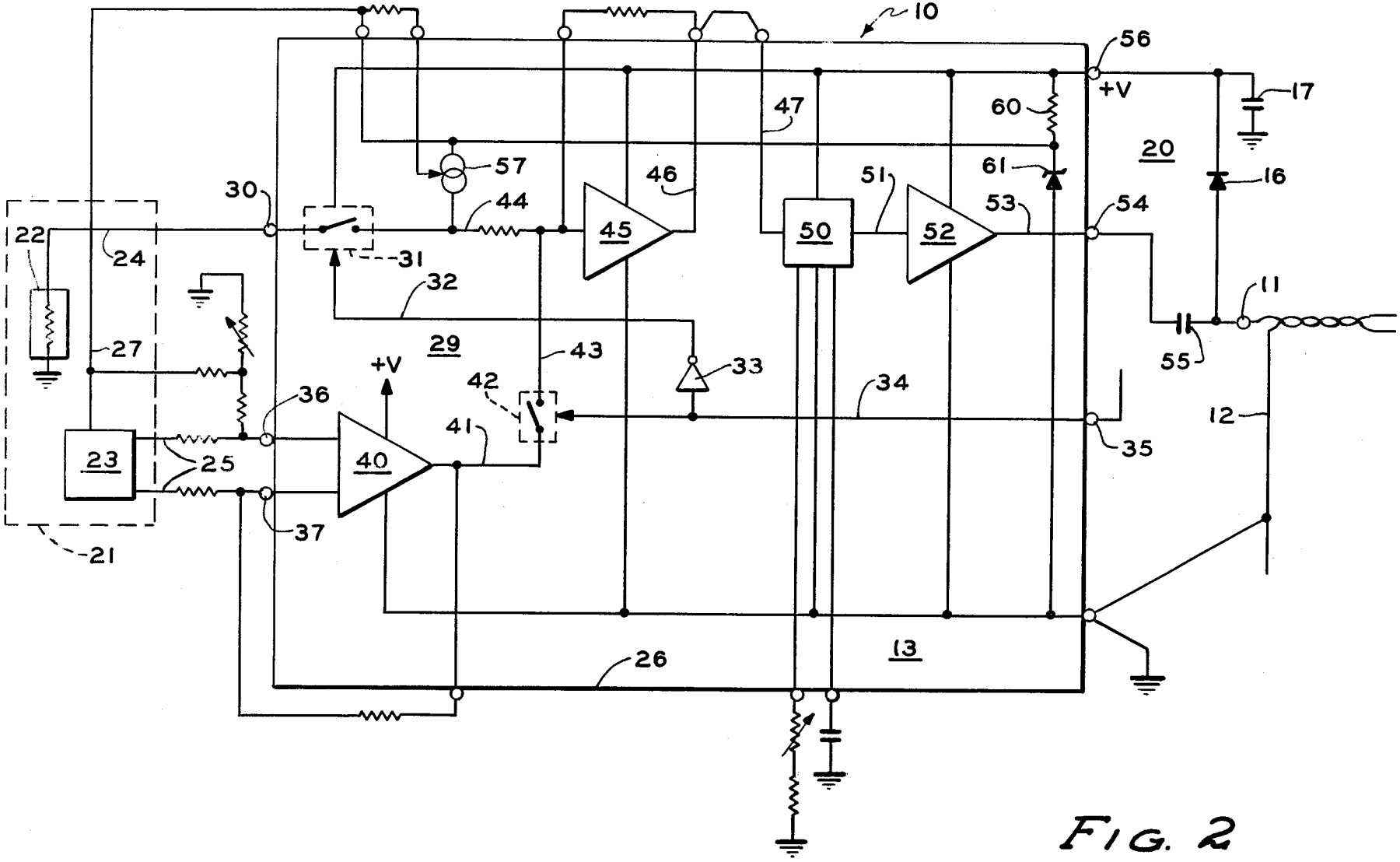
FIG. 2 is a schematic representation of one of the embodiments.

In FIG. 2 a complete schematic of the condition sensor interface means 10 is disclosed. A resistance type sensor 22 is more completely disclosed connected by conductor 24 to the integrated circuit 13. This connection can be accomplished on the substrate 20 that was disclosed in FIG. 1. All of the discrete components that are disclosed in FIG. 1 are again disclosed in detail in FIG. 2 as existing around the perimeter 26 of the integrated circuit 13. The specific components that are mounted on the substrate 20 around the perimeter 26 of the integrated circuit 13 will not be specifically identified as they are conventional components, and their functions are well known. Only the overall interconnection of the device and function will be described.

The condition sensor 23 is disclosed as a voltage type of condition sensor that has an input conductor 27 for the application of an energizing voltage and has an output on the conductors 25 of a voltage that is responsive to the condition being sensed. Voltage type sensors 23 could be Hall effect devices, photodiodes, or Permalloy type sensors. Other integrated sensors which generate an alternating current type output (i.e. capacitive sensors) can also be used. In one particular embodiment of particular utility, the sensor 22 would be a resistance type of temperature sensor, and the sensor 23 would be a humidity type of capacitive sensor. With this arrangement both temperature and humidity could be sensed within a residential condition control system and an output supplied on conductors 11 and 12 that is indicative of the two conditions being sensed.

The condition sensor 22 is connected by the conductor 24 to the integrated circuit 13 at a terminal 30. Terminal 30 is internally connected to a switch means 31 that has a connection 32 in digital logic gate circuitry through an inverter gate 33 to a further conductor 34. Conductor 34 is connected to a selection terminal 35 that is of particular interest in connection with the present invention. The terminal 35 is used for the application of either the ground potential to the device, or the positive potential supplied to the device to make a selection of which of the sensors is to be active. This selection process will be explained in detail after the circuitry has been completely disclosed.

The voltage sensor 23 is connected by the conductors 25 through a pair of terminals 36 and 37. The terminals 36 and 37 supply the sensed output from the sensor 23 to an amplifier 40 that has an output conductor 41 to a second switch means 42 that is controlled by the conductor 34 from the terminal 35. Switch means 31 and 42 form the output of a mode selection means disclosed generally at 29. The switch means 42 has an output conductor 43 that is common with a conductor 44 that is the output from the switch means 31. The conductors 44 and 43 combine signals from the two sensors 22 and 23 selectively under the control of the switch means 31 and 42 to a scaling amplifier 45. The scaling amplifier 45 has an analog type of output at 46 that is representative of the sensed condition from one or the other of the sensors 22 or 23. The scaling amplifier 45 provides its output through conductors 46 and 47 to a voltage controlled oscillator means or digital signal output means 50. Additional signal processing which may be desired, such as filtering, can be placed in this circuit, and therefore conductors 46 and 47 are joined externally to the integrated circuit 13. The voltage controlled oscillator means 50 is energized and controlled so as to provide an output at the conductor 51 that is a digital representation of the analog signal at the output conductor 46 of the scaling amplifier 45. The voltage controlled oscillator means 50, in effect, provides an on-off step type of digital signal that has a frequency that is a function of the condition being sensed. The output conductor 51 from the voltage controlled oscillator means 50 drives a line driver 52 that in turn has an output conductor 53 that is connected to a terminal 54 that is coupled through a capacitor 55 to the positive conductor 11 of the power source for the present device. The line driver 52 pulls down the line voltage on conductor 11 and thereby provides an output signal on the conductors 11 and 12 that is a digital representation of the output of the voltage controlled oscillator means 50. During transmission of the output signal, voltage is maintained constant to integrated circuit 13 by the voltage on a capacitor 17 which is charged through a diode 16. Diode 16 also prevents the output signal on line 11 from coupling into the integrated circuit 13 power supply. The power source output impedance must be low enough to supply sufficient power to the sensor interface and yet have a high enough output impedance to minimize the sinking requirements of the sensor interface driver.

Within the integrated circuit 13 there further is a constant current generator disclosed at 57 that is supplied with potential from the terminal 56 through the voltage regulating resistor 60 and the zener diode 61 so that the constant current generator 57 can provide a constant current to the sensor means 23.

OPERATION OF FIG. 2

In the circuit disclosed in FIG. 2 two separate types of sensors 22 and 23 are disclosed as a resistive sensor 22 and a voltage sensor 23. Assuming that these sensors are a temperature sensor and a capacitive type of humidity sensor, a particular application for the circuit of FIG. 2 will be described. The sensors 22 and 23 would be the sensing means for the condition sensor interface means 10 and typically would be mounted on the substrate 20. This substrate structure would then be mounted in a residential environment to sense both temperature and humidity to control a furnace and humidifying equipment. The conductors 11 and 12 would be supplied with a direct current potential and at the same time would be coupled to a control device, such as a microprocessor, where the digital output signal on the conductors 11 and 12 could be interpreted as to the temperature and humidity present at the condition sensor interface means 10.

A selection of which sensor is to be activated can be made either locally at the substrate 20, or can be made remotely by the connection of a conductor to the terminal 35. The simplest means of explaining the operation will be to assume that a connection is being made at the substrate 20. If it is first assumed that the terminal 35 is energized by a connection from the terminal 35 to the terminal 56 (wherein a positive voltage is connected to terminal 35 from the power source that is provided through the diode 16) it can be seen that a fixed positive potential is available. If this potential is considered to be a digital logic 1, the arrangement provides for the logic gates or switch means 31 and 42 to be differentially energized. The logic 1 connected to the terminal 35 is inverted by logic device 33 where it becomes a logic 0 at the switch means 31. A logic 0 at the switch means 31 closes the switch means 31 connecting the sensor 22 to the scaling amplifier 45. The logic 1 at the conductor 34 causes the switch means 42 to be open circuited, and the output of the amplifier 40 is disconnected thereby disconnecting the output of the sensor 23.

The scaling amplifier 45 receives the resistance indicating voltage from the sensor 22 and converts it to an appropriate analog output at the conductor 46 where it is used to control the voltage controlled oscillator means 50. The voltage controlled oscillator means 50 periodically energizes the line driver 52 and the line 53 is pulled down to load the input conductor 11 through the coupling capacitor 55. This loading appears as a digital output signal at the conductors 11 and 12, and is supplied to the control equipment (not shown), in the form of a microprocessor. This microprocessor then in turn controls a furnace or other heating equipment.

When it is desired to sample the humidity at the location being controlled, the terminal 35 is connected to the ground conductor thereby providing a logic 0 to the conductor 34. This causes the switch means 31 to open, and the switch means 42 closes. This disconnects the temperature responsive resistor 22 from the scaling amplifier 45 and allows the output of the humidity sensitive sensor 23 to be amplified through the amplifier 40 as an input to the scaling amplifier 45. At this point the operation of the system is the same as with the resistance sensor 22, and the output of the sensor 23 is provided at the conductors 11 and 12 to the controlled equipment.

It is quite apparent that the terminal 35 can be connected to a positive or ground potential remote from the substrate 20 and therefore remote control of the selection of the sensors 22 and 23 can be accomplished. This can be done by the microprocessor sampling the temperature and the humidity in the control system in a pattern established for the particular installation requirements.

Figure 3:
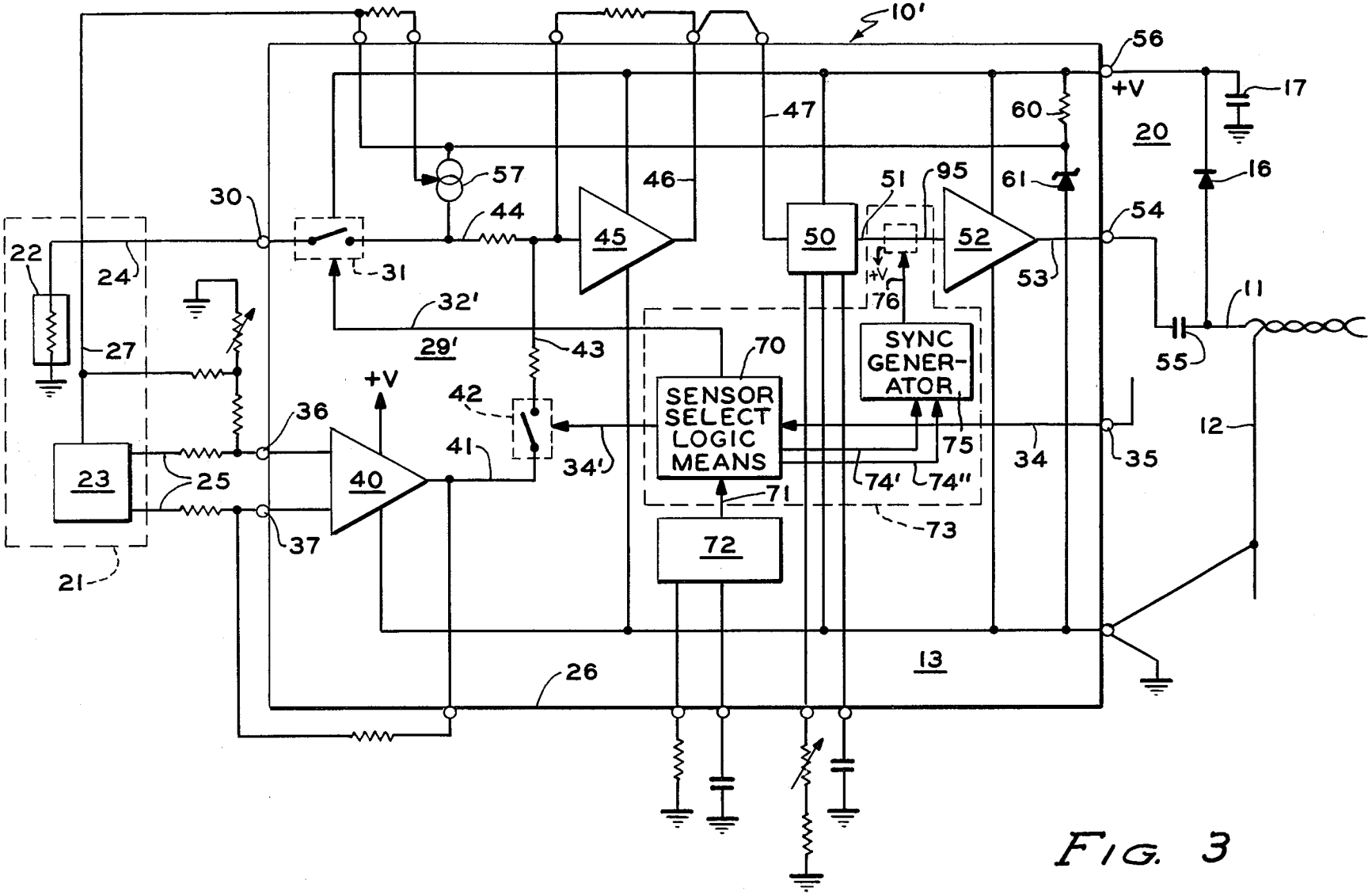
FIG. 3 is a schematic representation of a second embodiment.

In FIG. 3 an alternate embodiment of the present invention is disclosed. Similar components and functions to that disclosed in FIG. 2 will carry the same reference numbers as in FIG. 2, and only the additional circuitry and functions will be discussed herein. The mode selection means 29 of FIG. 2 basically included the switch means 31 and 42, the inverter gate 33, and the conductor 34 and has been significantly altered to alter the function of the device. In FIG. 3 the mode selection means 29′ is disclosed which still utilizes the switch means 31 and 42, but their manner of control is significantly different.

The mode selection means 29′ further includes a sensor select logic means 70 which is functionally part of a subcircuit 73 which controls the selection of a sensor and further identifies which sensor is selected. The details of subcircuit 73 are shown in detail in FIG. 4. The sensor select logic means 70 has an output at conductor 34′ to control the switch means 42 and further has an output at conductor 32′ to control the switch means 31. The sensor select logic means 70 has an input at 71 which is driven from a free running multivibrator disclosed at 72. The free running multivibrator 72 is any type of timing means which alternately provides a switched logic signal to the sensor select logic means 70. The specific details of the free running multivibrator 72 or timing means 72 is not material beyond the fact that it continuously provides the sensor select logic means 70 with a switched logic signal of an alternate nature. The sensor select logic signal means 70 further has an input from the conductor 34. When a digital logic 0 is placed on the conductor 34, the sensor select logic means 70 is disabled, and a preselected decision on whether the switch means 31 or the switch means 42 is closed occurs. The sensor select logic means 70 has a further output at conductors 74′ and 74″. The signals on conductors 74′ and 74″ control the synchronous generator 75 to control and code the input to the line driver 52 by means of conductor 76 and switch means 93 and 94. The function of the added sensor select logic means 70 along with the free running multivibrator 72 and the synchronous generator 75 will be discussed below. It will be noted that the free running multivibrator 72 is of conventional design and therefore details of its structure are not shown. The synchronous generator 75 is included in subcircuit 73 and is shown in detail as part of FIG. 4. The sensor select subcircuit 73 can be any type of sensor select arrangement that is capable of providing the functions that will be described. For completion of the present invention, however, in FIG. 4 a typical embodiment of the subcircuit 73 is disclosed in detail. In FIG. 5 the timing relationship within the device is shown. The detail of internal operation of the sensor select subcircuit 73 is not material to the understanding of the present invention, and therefore an explanation of the operation of FIG. 3 will occur prior to any description of the specific components contained within the subcircuit 73.

OPERATION OF FIG. 3

The operation of the sensor interface means 10′ will be described in the environment of temperature and humidity control as was the case in FIG. 2. In the circuit of FIG. 3, two choices again occur in applying a digital logic 1 to the terminal 35, or the application of a digital logic 0 to terminal 35 as in FIG. 2. If a digital logic 1 is applied to terminal 35, the sensor select logic means 70 is activated to respond to the free running multivibrator or timing means 72 to repetitively cycle. This repetitive cycling provides a digital signal to each of the switch means 31 and 42, and then reverses the character of the digital signal so that the switch means 31 and 42 are repetitively opened and closed to alternately connect the sensors 22 and 23 to the scaling amplifier 45. This information is provided to the variable frequency oscillator means 50 and the line driver 52. At the same time, the synchronous generator 75 is operated. The output of variable frequency oscillator 51 is momentarily disconnected at 95 by synchronous generator 75. At the same time the synchronous generator 75 enables 95 to provide a positive potential signal to the line driver 52. This arrangement is provided to code the signal to the line driver 52 so that the digital signals supplied at the output conductor 11 can be identified as to whether it is a signal from the sensor 22 or from the sensor 23. In the embodiment disclosed, each time the free running multivibrator 72 changes, that signal is used to disable the output of variable frequency oscillator means 50 and enable the positive potential signal at 95. This allows pulse width discrimination to be used for identifying the start and the stop of data from the sensors 22 and 23 so that the output sensing device, which has been indicated as a microprocessor, can identify which sensor is being utilized. With the terminal 35 thus connected to a digital logic 1, the sensors are alternatively sampled on a continuous basis.

If the terminal 35 is connected to a digital logic 0, the sensor select logic means 70 is disabled with an output on the conductors 34' and 32' preselected to close either the switch means 31 or the switch means 42 to continuously sample either the sensor 22 or the sensor 23. In most residential installations, the temperature sensor 22 would be of primary concern, and the humidity sensor 23 would be of secondary concern. As such, when the terminal 35 has a digital logic 0 impressed on it, the switch means 31 would normally be closed with the switch means 42 being open. This would provide a continuous signal to the scaling amplifier 45 of the resistance value for the sensor 22 which would be indicative of the temperature being sensed. This would supply a continuous signal on the conductors 11 and 12 of the sensed temperature. Once again the terminal 35 could be selected locally or could be remotely selected by the microprocessor or control equipment to sample the temperature and humidity, as is necessary for the particular control installation.

Figure 4:
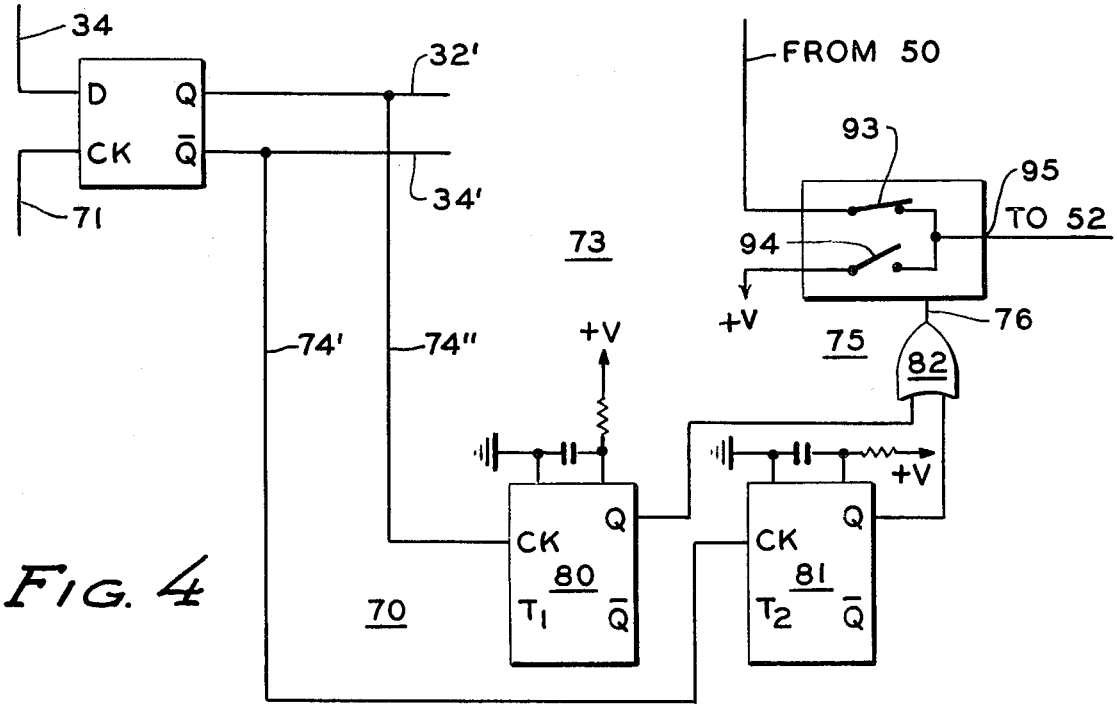
FIG. 4 is a detailed circuit diagram of part of the device of FIG. 3.
Figure 5:
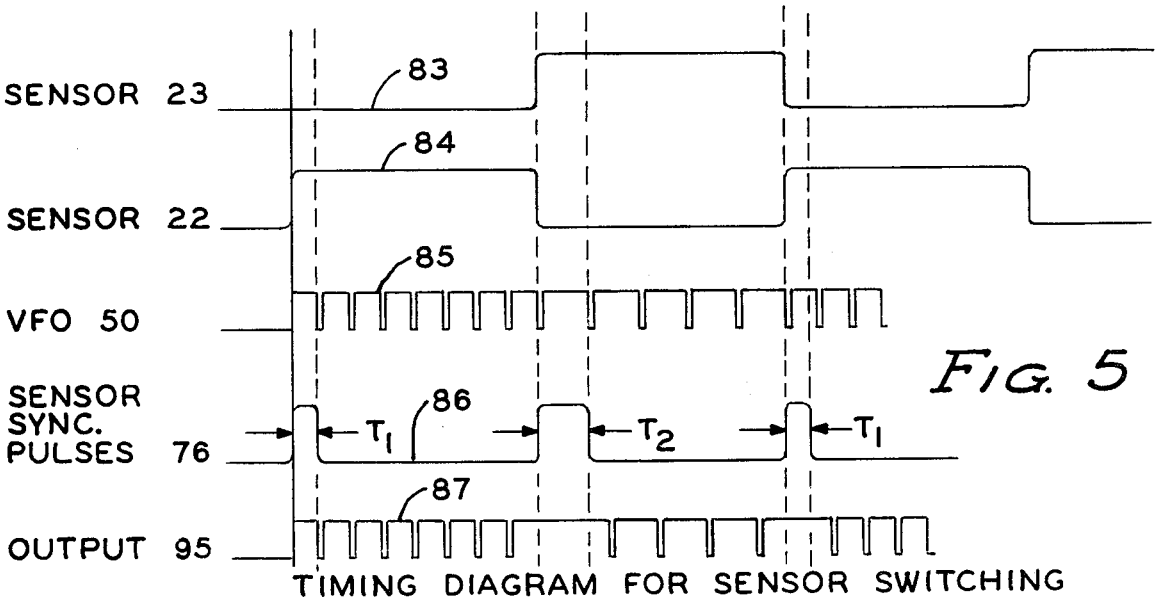
FIG. 5 is a timing diagram of the operation of FIG. 3.

In FIG. 4 a detailed circuit showing the subcircuit 73 is provided. This detailed circuit utilizes conventional digital logic elements and will only be briefly described. The inputs to the circuit is the conductor 34 and the output of the multivibrator 72 at conductor 71. These inputs drive a conventional D flip-flop which has a pair of opposite outputs connected to the conductors 32' and 34'. These two outputs directly drive the switch means 31 and 42 so that when one is open, the other is closed. The outputs from the conductors 32' and 34' further drive into a portion of the subcircuit 73 that has been identified as the sensor select logic means 70. This logic means is made up of a pair of monostable multivibrators 80 and 81 which drive the OR gate 82. The OR gate 82 operates a pair of switches 93 and 94 that connect and disconnect the output 95 from the variable frequency oscillator 50 to the line driver 52.

In operation the switches 93 and 94 allow for the variable frequency oscillator 50 to drive the line driver 52 and then for the signal to be interrupted for the impression of synchronizing pulses which are shown schematically in FIG. 3 as occurring on the conductor 76. It is believed that the operation of this circuit will become obvious when FIG. 5, which is a timing diagram, is explained.

In FIG. 5 a timing diagram for the sensor switching is shown. The first wave form disclosed is the on and off selection of the output of a sensor identified as sensor 23. The wave form shows that the sensor 23 is at first deactivated and is then read at an output on conductor 11. The timing diagram wave form 84 shows the selection of the sensor 22. It shows that sensor 22 is being read or selected when the sensor 23 is out of the sensing circuit. The third wave form disclosed at 85 is the output 50 of the variable frequency oscillator showing the changes due to the conditions sensed by sensors 22 and 23. The sensor synchronization pulses on conductor 76 are shown as the fourth wave form at 86. A fifth wave form 87 shows the resulting pulses which appear at the output 95 and comprise the digital data to be sent to the line driver 52.

In the wave form 86 the timing of the synchronizing pulses at conductor 76 is shown. The first timing pulse t1 is a short timing pulse and occurs at the input of the line driver 52 at the time that the output from the variable frequency oscillator 50 is disabled. A subsequent time interval t2 occurs which in turn causes the system to read the sensor 23, but the time interval is a longer time interval than t1. This allows the output control device, which typically would be a microprocessor, to determine which sensor was being read. As the time sequence proceeds, the sensors are again reversed and the shorter time interval t1 occurs to identify which sensor is being outputted. With this arrangement, it is quite clear that the sensors 22 and 23 are alternated, that the output of the variable frequency oscillator means 50 is momentarily interrupted as the alternation of sensors occurs. The timing for each of the interrupted periods allows for identification of the outputted sensor signal. With the arrangement thus disclosed it is possible to repetitively cycle the output of the sensors 22 and 23 and identify which sensor is being read.

As can be seen from a consideration of the circuits disclosed, considerable variation can be accomplished in the present application by altering the type of electronics used and the mode of operation. Since the invention can be applied to numerous physical structures, the applicants wish to be limited in the scope of their invention solely by the scope of the appended claims.

The embodiments of the invention in which an exclusive property or right is claimed are defined as follows:

1. A condition sensor interface means responsive to sensor means with said interface means utilizing a pair of input conductors to both power said interface means and to output information from said sensor means, including: condition sensor means responsive to at least one condition to be sensed; sensor interface means including sensor input means connected to said sensor means with said sensor interface means having two modes of operations; said sensor interface means having mode selection means whereby two sensing modes are selectable within said sensor interface means by the application of two different mode selection voltages to said mode selection means; said sensor interface means further including digital signal output means which has input means responsive to said sensor means through said mode selection means; power terminal means for said sensor interface means with said terminal means adapted to be connected by said pair of conductors to a direct current source to energize said sensor interface means; and said digital signal output means having output circuit means connected to said pair of input conductors to load said direct current source to in turn provide a digital output signal on said pair of conductors in response to a condition sensed by said sensor means.

2. A condition sensor interface means as described in claim 1 wherein said digital signal output means includes variable frequency oscillator means.

3. A condition sensor interface means as described in claim 2 wherein said condition sensor means includes two condition sensor elements with a first of said elements being a variable resistance in response to a first condition to be measured; and a second of said elements having a variable voltage output in response to a second condition to be measured.

4. A condition sensor interface means as described in claim 3 wherein said sensor means and said sensor interface means are mounted on a common insulating surface.

5. A condition sensor interface means as described in claim 4 wherein said sensor interface means is a hybrid circuit including integrated circuit means and discrete components mounted upon an insulating surface which is in turn a ceramic substrate.

6. A condition sensor interface means as described in claim 3 wherein said variable frequency oscillator output means includes line driver means to load said direct current source to output said digital signal on said pair of conductors.

7. A condition sensor interface means as described in claim 6 wherein said mode selection means includes switch means and digital logic gates with said switch means controlled by said digital logic gates to provide said two sensing modes in response to the said two different mode selection voltages.

8. A condition sensor interface means as described in claim 6 wherein said mode selection means includes repetitive alternate action switching means to cause said two sensor elements to alternately be sampled to provide a repetitive alternate output on said pair of conductors in response to a first of said two different mode selection voltages; and said mode selection means having a fixed selection mode in response to a second of said two different mode selection voltages.

9. A condition sensor interface means as described in claim 8 wherein said mode selection means includes free running multivibrator means driving sensor select logic means when said first of said two different mode selection voltages is connected to said mode selection means.

10. A condition sensor interface means as described in claim 9 wherein said mode selection means further includes synchronous generator means that is enabled by said sensor select logic means to encode said output circuit means of said variable frequency oscillator with a coded signal identifying which of said sensor elements is being responded to by said sensor interface means.

11. A condition sensor interface means as described in claim 10 wherein said sensor select logic means disables said variable frequency oscillator means when said synchronous generator means is enabled.

12. A condition sensor interface means as described in claim 11 wherein said first sensor element is temperature responsive and said second sensor element is humidity responsive.

13. A condition sensor interface means as described in claim 7 wherein said first sensor element is temperature responsive and said second sensor element is humidity responsive.

* * * * *